US005433131A

United States Patent [19]

Suzuki

[11] Patent Number: 5,433,131

[45] Date of Patent: Jul. 18, 1995

[54] KEYBOARD COVER APPARATUS FOR ELECTRONIC KEYBOARD INSTRUMENT

[75] Inventor: Akihiro Suzuki, Hamamatsu, Japan

[73] Assignee: Kabushiki Kaisha Kawai Gakki Seisakusho, Shizuoka, Japan

[21] Appl. No.: 966,752

[22] Filed: Oct. 27, 1992

[51] Int. Cl.[6] ..... G10C 3/02

[52] U.S. Cl. ..... 84/179; 84/423 R; 84/DIG. 17; 49/254; 220/335

[58] Field of Search ..... 84/178, 179, 423 R, 84/DIG. 17; 49/254, 208; 220/335

[56] References Cited

U.S. PATENT DOCUMENTS 2,481,103 9/1949 Fuller ..... 84/178

5,150,806 9/1992 Glomski ..... 220/335

*Primary Examiner*—Michael L. Gellner

*Assistant Examiner*—Cassandra Spyrou

*Attorney, Agent, or Firm*—Armstrong, Westerman, Hattori, McLeland & Naughton

[57] ABSTRACT

A keyboard cover apparatus for an electronic keyboard instrument has a keyboard main body having a supporting member on each side thereof. A keyboard cover member has an arm on each side thereof and the arm is rotatably supported by the supporting member. An interlocking device is provided to hold the keyboard cover member in a first closing position in which a predetermined clearance is maintained between the keyboard cover member and the keyboard main body and in a second position in which the clearance is substantially eliminated.

5 Claims, 2 Drawing Sheets

KEYBOARD COVER APPARATUS FOR ELECTRONIC KEYBOARD INSTRUMENT

BACKGROUND OF THE INVENTION

The present invention relates to a keyboard cover apparatus for an electronic keyboard instrument.

A conventional keyboard cover apparatus for an electronic keyboard instrument is rotatably supported by supporting shafts on a keyboard main body. It has, therefore, a disadvantage in that, when it is closed or let go down by mistake from its open position, an operator may be exposed to the possibility of injuring himself or herself by pinching his or her fingers between the keyboard main body and the keyboard cover member due to the gracity of the keyboard cover.

OBJECT AND SUMMARY OF THE INVENTION

Considering the above-described disadvantage, one object of the present invention is to eliminate such a disadvantage in a keyboard cover apparatus for an electronic keyboard instrument. Another object is to make the keyboard cover apparatus simple in construction and removable from the keyboard main body.

According to the present invention, the foregoing and other objects are attained by a keyboard cover apparatus for an electronic keyboard instrument which comprises a keyboard main body having a supporting member on each side thereof and a keyboard cover member having an arm on each side thereof. Each of the arms is rotatably supported by the supporting member. Interlocking device is provided for holding the keyboard cover member in a first closing position in which a predetermined clearance is maintained between the keyboard cover member and the keyboard main body and in a second position in which the clearance is substantially eliminated.

Preferably, the interlocking device comprises a stopper member for tentatively holding the keyboard cover member in the first closing position and a first slot in the arm for receiving the supporting member into engagement therewith in the second closing position.

The interlocking device preferably further comprises a second slot in the arm for receiving therein the stopper member in the second closing position.

Preferably, the first slot and the second slot are provided substantially in parallel to each other at an end of the arm remote from the keyboard cover member so as to have respectively a closed end and an open end which look substantially upwards when the keyboard cover member is in open position and substantially looks downwards when the keyboard cover member is in the first and second closing positions. The stopper member is fixed near the supporting member, and the second slot has an engaging portion near the open end for tentatively engaging with the stopper member in the first closing position such that a change of the keyboard cover member from the first closing position to the second closing position is attained by a gravity of the keyboard cover through a slightly upward pull of the keyboard cover towards an operator, thereby bringing the stopper member out of engagement with the engaging portion.

The first slot preferably further comprises an extended portion which extends from the closed end substantially at right angle to the first slot such that the keyboard cover member can be placed into or removed out of engagement with the supporting member through the extended portion.

In a preferable mode of operation, the arm is rotated about the supporting member which is engaged with the arm at the closed end of the first slot. When the keyboard cover member is rotated to the first closing position, namely, to a nearly horizontal posture in which there is left a predetermined distance between the keyboard main body and the keyboard cover member, the arm is stopped and tentatively held in its position by the arm's abutting with the stopper member. When the keyboard cover member is pulled slightly upwards towards the operator, the stopper member becomes out of engagement with the engaging portion and is fitted into the the second slot. The keyboard cover member will then lowers through its own gravity, while changing the positions of engagement of the supporting member and the stopper member, respectively, with the first slot and the second slot, namely from the first closing position to the second closing position in which the keyboard main body and the keyboard cover member are in abutment with each other.

BRIEF DESCRIPTION OF THE DRAWINGS

The above and other objects and the attendant advantages of the present invention will become readily apparent by reference to the following detailed description of the drawings when considered in conjunction with the accompanying drawings wherein.

DETAILED DESCRIPTION OF A PREFERRED EMBODIMENT

One embodying example of the present invention will now be explained with reference to the accompanying drawings.

Figure 1:
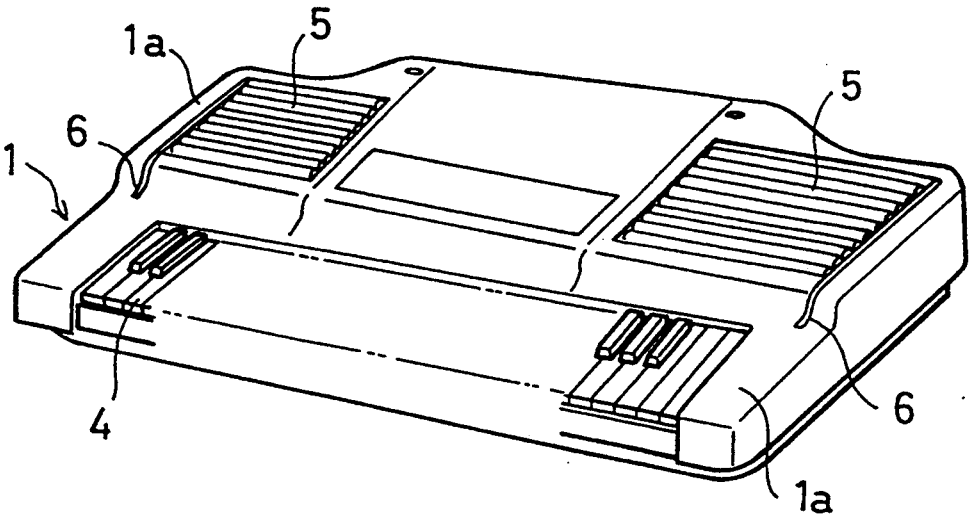
FIG. 1 is a perspective view of an electronic keyboard instrument to which the present invention is applied.
Figure 2:
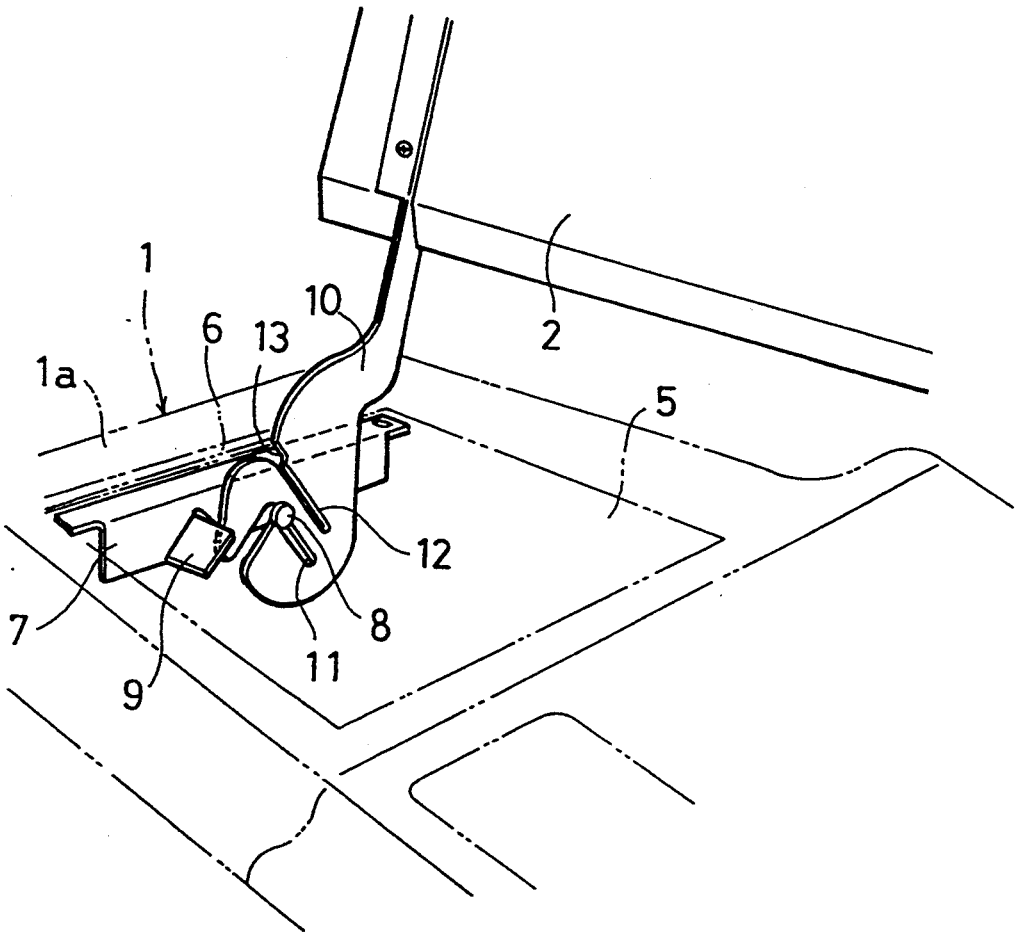
FIG. 2 is a perspective view of an important portion thereof.

Referring to the drawings, numeral 1 denotes a keyboard main body of an electronic keyboard instrument and numeral 2 denotes a keyboard cover member. The keyboard main body 1 comprises an upper case 1*a* and a lower case 1*b*. Like in a conventional electronic keyboard instrument, the lower case 1*b* has attached thereto a base plate 3 which is provided with keyboard switches, and a keyboard 4. On the right and left sides of the upper case 1*a*, there are formed speaker mounting portions 5, 5 and slots 6, 6 into each of which a keyboard cover arm is fitted as described later. An L-shaped plate member 7 (only one side is illustrated in FIG. 2) is fixed with unillustrated screws to the internal side of the upper case 1*a* in close proximity to each of the slots 6, 6. This plate member 7 is respectively provided with a horizontally extending supporting shaft 8 and a stopper 9.

Figure 3:
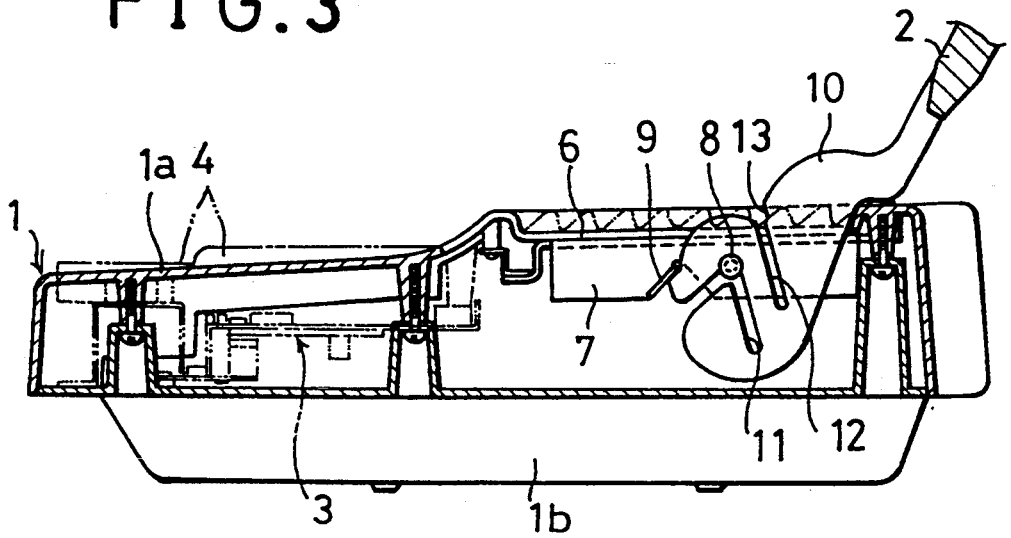
FIG. 3 is a sectional view of an electronic keyboard instrument when the keyboard cover member is open.

On both sides of the keyboard cover member 2, there are fixed keyboard cover arms 10, 10. At the front end (i.e., the end remote from the keyboard cover) of each of the arms 10, 10, there are provided a first slot 11 and a second slot 12 in such a manner that, when the keyboard cover member 2 is in an open position as shown in FIGS. 2 and 3, there is formed a substantially inverse "E" character. In other words, the front end of the arm 10 includes a central portion having two sides which partially extend straight in parallel with each other, and two side portions the inner sides of which are separated from the central portion respectively by the first slot 11 and the second slot 12 and which extend substantially in parallel with the two sides of the central portion.

The keyboard cover member 2 is supported so as to be rotatable about the horizontally extending supporting shafts 8, , by fitting the first slots 11, 11 which are formed on the front end side of the cover arms 10, 10, into the respective supporting shafts 8, 8.

Each of these first slots 11, 11 may be either closed or open at its upper end, as seen when the keyboard cover member 2 is in its open position, as long as the keyboard cover member 2 can be rotatably supported. Each of these first slots 11, 11 may be further extended substantially at right a angle to the first slot 11 so as to have a free, open end.

Figure 4:
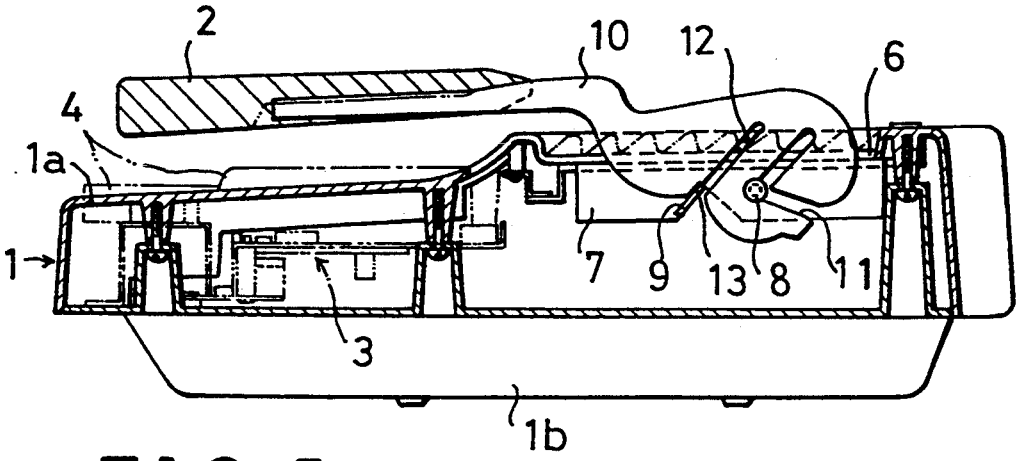
FIG. 4 is a sectional view of an electronic keyboard instrument when the keyboard cover member is in an intermediate closing position in which there is a predetermined clearance left between the keyboard main body and the keyboard cover member.
Figure 5:
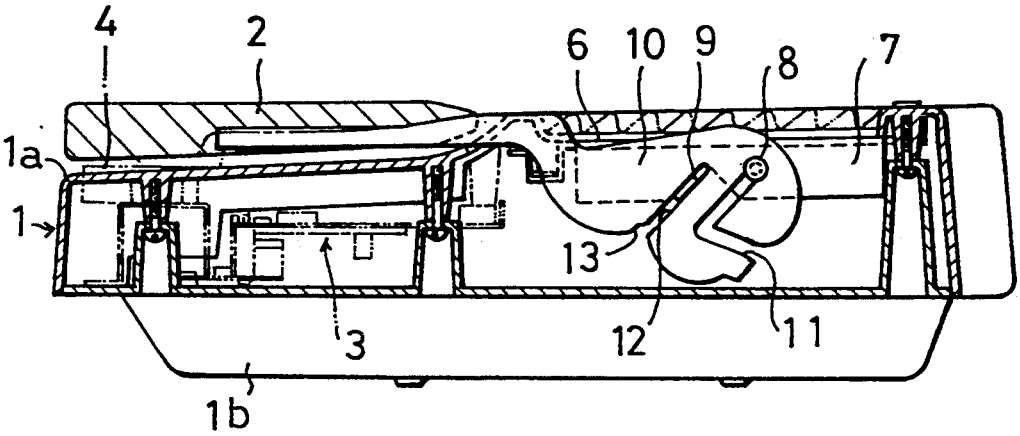
FIG. 5 is a sectional view of an electronic keyboard instrument when the keyboard cover member is in a closed position.

The open and closing conditions are explained with reference to FIGS. 3 through 5.

In FIG. 3 in which the keyboard cover member is shown to be open, the keyboard cover member 2 can be pulled upwards out of engagement with the horizontally extending supporting shafts 8, 8. If the keyboard cover member 2 is rotated counterclockwise from the condition shown in FIG. 3, it tentatively stops at a first closing position. This first closing position is one in which the keyboard cover member 2 becomes substantially horizontal while leaving a predetermined clearance when a stepped or engaging portion 13 formed at the open end of the second slot 12 in the supporting arm 10 comes into abutment with the stopper 9. The predetermined clearance may, for example, be one to prevent the operator from injuring himself or herself by pinching his or her fingers therebetween. In this arrangement, even if the keyboard cover member is inadvertently closed, the operator will not injure himself or herself by pinching his or her fingers between the keyboard main body 1 and the keyboard cover membr 2. Next, as shown in FIG. 4, when the keyboard cover member 2 is slightly lifted while pulling it towards the operator, the stopper 9 comes out of engagement with the stepped engaging portion 13 of the second slot 12 and will be put into fitting with the second slot 12. It follows that, when the keyboard cover member 2 is thereafter released from hands, it goes down by its own gravity. As a result, the slidingly engaging positions of the supporting shafts 8, 8 with the first slots 11, 11 and of the stopper members 9, 9 with the second slots 12, 12 move upwards as shown in FIG. 5. The keyboard cover member 2 will thus be in the second closing position, i.e., a closed position, in which there will be substantially no clearance between the keyboard cover member 2 and the keyboard main body 1.

The keyboard cover member 2 can be removed off the keyboard main body 1 by releasing the supporting member 8 out of engagement with the first slot 11 through the extended portion thereof.

As described hereinabove, since the present invention has the above arrangement, there is no possibility of the operator's injuring himself or herself by pinching his or her fingers between the keyboard cover member and the keyboard main body even if the keyboard cover member should be closed by mistake. Further, the present invention has the advantage in that the keyboard cover member can be removed off the keyboard main body in a simple construction.

It is readily apparent that the above-described keyboard cover apparatus for an electronic keyboard instrument meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A keyboard cover apparatus for an electronic keyboard instrument, comprising:

a keyboard main body;

a first supporting member on a first side of the keyboard main body;

a second supporting member on a second side of the keyboard main body;

a keyboard cover member;

a first arm on a first side of the keyboard cover member;

a second arm on a second side of the keyboard cover member;

said first arm being rotatably supported by said first supporting member, said second arm being rotatably supported by said second supporting member; and interlocking means for (1) holding said keyboard cover member in an open position in which said keyboard cover member is rotated away from said keyboard main body so as to leave said keyboard main body substantially unobstructed, for (2) rotation of said keyboard cover about said first and second supporting members to a first closing position in which said keyboard cover member is substantially closer to said keyboard main body than in said open position and in which a predetermined clearance is maintained between said keyboard cover member and said keyboard main body and in which said keyboard cover member is substantially horizontal so as to extend substantially parallel over keys of the electronic keyboard, and for (3) lowering of said keyboard cover member from said first closing position downwardly to in a second closing position which said clearance is substantially eliminated.

2. A keyboard cover apparatus for an electronic keyboard instrument according to claim 1, wherein said interlocking means includes an engaging portion on each of said first and second arms, and includes first and second stopper members mounted to said keyboard main body which are engageable with said engaging portions on said first and second arms, respectively, for tentatively holding said keyboard cover member in said first closing position and includes a first slot in each said first and second arms for receiving said first and second supporting members, respectively, in engagement therewith.

3. A keyboard cover apparatus for an electronic keyboard instrument, comprising:

a keyboard main body;

a first supporting member on a first side of the keyboard main body;

a second supporting member on a second side of the keyboard main body;

a keyboard cover member;

a first arm on a first side of the keyboard cover member;

a second arm on a second side of the keyboard cover member;

said first arm being rotatably supported by said first supporting member, said second arm being rotatably supported by said second supporting member; and interlocking means for holding said keyboard cover member in an open position in which said keyboard cover member is rotated away from said keyboard main body so as to leave said keyboard main body substantially unobstructed, in a first closing position in which said keyboard cover member is rotated substantially closer to said keyboard main body than in said open position and in which a predetermined clearance is maintained between said keyboard cover member and said keyboard main body, and in a second closing position in which said clearance is substantially eliminated;

wherein said interlocking means includes an engaging portion on each of said first and second arms, and includes first and second stopper members mounted to said keyboard main body which are engageable with said engaging portions on said first and second arms, respectively, for tentatively holding said keyboard cover member in said first closing position and includes a first slot in each said first and second arms for receiving said first and second supporting members, respectively, in engagement therewith;

wherein said interlocking means further includes a second slot in each of said arms for receiving therein said first and second stopper members, respectively, in said second closing position.

4. A keyboard cover apparatus for an electronic musical keyboard instrument according to claim 3, wherein said first and said second slot in each of said arms are provided substantially in parallel to each other at an end of each of said arms remote from said keyboard cover member, said second slots each having a closed end and each having an open end which faces substantially upwards when said keyboard cover member is in said open position and which substantially faces downwards when said keyboard cover member is in both said first and second closing positions, wherein each of said first and second stopper members is fixed near said first and second supporting members, respectively, and wherein each of said first and second engaging portions is located near the open end of each of said second slots, respectively, such that a change of said keyboard cover member from said first closing position to said second closing position is attained by a gravity of said keyboard cover member through a pull of said keyboard cover member bringing the first and second stopper members out of engagement with the first and second engaging portions and into said second slots.

5. A keyboard cover apparatus for an electronic keyboard instrument according to claim 3, wherein each of said first slots includes an extended portion which extends substantially at a right angle to an inner portion of said first slot, said keyboard cover member being capable of being placed into or removed out of engagement with each of said first and second supporting members through said extended portions.

* * * * *

UNITED STATES PATENT AND TRADEMARK OFFICE

CERTIFICATE OF CORRECTION

PATENT NO.: 5,433,131
DATED : July 18, 1995
INVENTOR(S): Akihiro SUZUKI

It is certified that error appears in the above-identified patent and that said Letters Patent is hereby corrected as shown below:

Column 4, line 52, delete "in";

line 53, after "position" insert --in--.

Signed and Sealed this

Twenty-sixth Day of December, 1995

Bruce Lehman

*Attest:*

BRUCE LEHMAN

*Attesting Officer*

*Commissioner of Patents and Trademarks*